US011039526B2

(12) United States Patent
Suzuki et al.

(10) Patent No.: US 11,039,526 B2
(45) Date of Patent: Jun. 15, 2021

(54) X-RAY GENERATION DEVICE

(71) Applicant: HAMAMATSU PHOTONICS K.K., Hamamatsu (JP)

(72) Inventors: Kazutaka Suzuki, Hamamatsu (JP); Yuji Shirayanagi, Hamamatsu (JP); Motofumi Tanaka, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/619,601

(22) PCT Filed: Feb. 26, 2018

(86) PCT No.: PCT/JP2018/006985
§ 371 (c)(1),
(2) Date: Dec. 5, 2019

(87) PCT Pub. No.: WO2018/225307
PCT Pub. Date: Dec. 13, 2018

(65) Prior Publication Data

US 2020/0154552 A1 May 14, 2020

(30) Foreign Application Priority Data

Jun. 7, 2017 (JP) ..... JP2017-112773

(51) Int. Cl.
*H05G 1/32* (2006.01)
*H05G 1/06* (2006.01)

(52) U.S. Cl.
CPC ..... *H05G 1/32* (2013.01); *H05G 1/06* (2013.01)

(58) Field of Classification Search
CPC ..... H05G 1/32; H05G 1/06
See application file for complete search history.

(56) References Cited

U.S. PATENT DOCUMENTS 4,646,338 A * 2/1987 Skillicorn ..... H01J 35/04 378/110
2012/0027179 A1* 2/2012 Ogata ..... H01J 35/045 378/101

(Continued)

FOREIGN PATENT DOCUMENTS

EP 0817546 A1 1/1998
EP 3544390 A1 9/2019

(Continued)

OTHER PUBLICATIONS

International Preliminary Report on Patentability dated Dec. 19, 2019 for PCT/JP2018/006985.

*Primary Examiner* — Hugh Maupin
(74) *Attorney, Agent, or Firm* — Faegre Drinker Biddle & Reath LLP

(57) ABSTRACT

An X-ray generation device includes an X-ray tube including an electron gun that generates an electron beam and a target that generates an X-ray by incidence of the electron beam; a power supply portion including a booster that boosts an input voltage from outside to generate a high voltage and an insulating block that seals the booster with an insulating material; and a control unit that performs control to generate the X-ray. The control unit includes a first information processing element that performs at least part of the control using a digital signal at a high potential based on the high voltage. The first information processing element is sealed with the insulating material in the insulating block.

3 Claims, 4 Drawing Sheets

(56) References Cited

U.S. PATENT DOCUMENTS

| | | | |
|---|---|---|---|
| 2014/0177805 | A1 | 6/2014 | Wang |
| 2015/0213994 | A1 | 7/2015 | Berk et al. |

FOREIGN PATENT DOCUMENTS

| | | | |
|---|---|---|---|
| JP | S63-52760 | B2 | 10/1988 |
| JP | 2005-166370 | A | 6/2005 |
| JP | 2006-520068 | A | 8/2006 |
| JP | 4889979 | B2 | 3/2012 |
| JP | 5780644 | B2 | 9/2015 |
| JP | 2017-79858 | A | 5/2017 |
| WO | WO-2004/075610 | A2 | 9/2004 |

* cited by examiner

X-RAY GENERATION DEVICE

TECHNICAL FIELD

An aspect of the present invention relates to an X-ray generation device.

BACKGROUND ART

Patent Literature 1 discloses an industrial X-ray generation device. The device is provided with an X-ray tube mounted on a base and having a cylindrical tubular body. The inside of the tubular body is provided with a cathode that emits electrons, a grid or an extraction electrode, and an anode that attracts electrons. The anode has targets with which electrons collide to generate X-rays. Furthermore, in this device, a high-voltage power supply portion including a booster circuit and a controller is provided on the base. The controller includes a microcomputer provided with, for example, a central processing unit (CPU) and a memory. The X-ray tube and the booster circuit are subjected to molding and covered with a molding material.

CITATION LIST

Patent Literature

Patent Literature 1: Japanese Patent No. 5780644

SUMMARY OF INVENTION

Technical Problem

In the aforementioned device, the controller is housed in an outer case. Accordingly, when the controller is operated at a high potential, the controller is heavily impacted by a discharge inside the device. Particularly, an information processing element, such as a microcomputer included in a controller, which performs information processing based on digital signals may be seriously damaged because such an element is designed on the premise of operating at a low potential and is weak against a discharge at a high potential where a potential difference becomes large. For that reason, it is difficult to perform stable control at a high potential.

An aspect of the present invention aims to provide an X-ray generation device that enables stable control at a high potential.

Solution to Problem

An X-ray generation device according to an aspect of the present invention includes an X-ray tube including an electron gun configured to generate an electron beam and a target configured to generate an X-ray by incidence of the electron beam; a power supply portion including a booster configured to boost an input voltage from outside to generate a high voltage and an insulating block configured to seal the booster with an insulating material; and a control unit configured to perform control to generate the X-ray, wherein the control unit includes a first information processing element configured to perform at least part of the control using a digital signal at a high potential based on the high voltage, wherein the first information processing element is sealed with the insulating material in the insulating block.

The X-ray generation device is provided with the X-ray tube, the power supply portion, and the control unit. The power supply portion includes the booster that boosts an input voltage from outside to generate a high voltage. The booster is sealed with the insulating material in the insulating block. The control unit that performs the control to generate the X-ray includes the first information processing element that performs at least part of the control to generate the X-ray using a digital signal at a high potential based on the high voltage. The first information processing element is sealed with the insulating material in the insulating block. Accordingly, the first information processing element enables stable control even at a high potential.

In the X-ray generation device according to an aspect of the present invention, the power supply portion may further include a conductive member which covers at least a part of the first information processing element and which is sealed with the insulating material in the insulating block, and a voltage based on the high voltage may be applied to the conductive member. In this case, an electric field around the first information processing element is stabilized, which enables stable operation of the first information processing element.

In the X-ray generation device according to an aspect of the present invention, the first information processing element may control the electron gun at a high potential. In this case, it is possible to stably control the generation and emission of the electron beam from the electron gun.

In the X-ray generation device according to an aspect of the present invention, the control unit may further include a second information processing element that performs the control at a low potential based on a low voltage lower than the high voltage, and the second information processing element may be disposed outside the insulating block. In this case, the generation and emission of the electron beam is stably controlled by the second information processing element disposed outside the insulating block.

Advantageous Effects of Invention

According to an aspect of the present invention, there is provided an X-ray generation device that enables stable control at a high potential.

DESCRIPTION OF EMBODIMENTS

Figure 1:
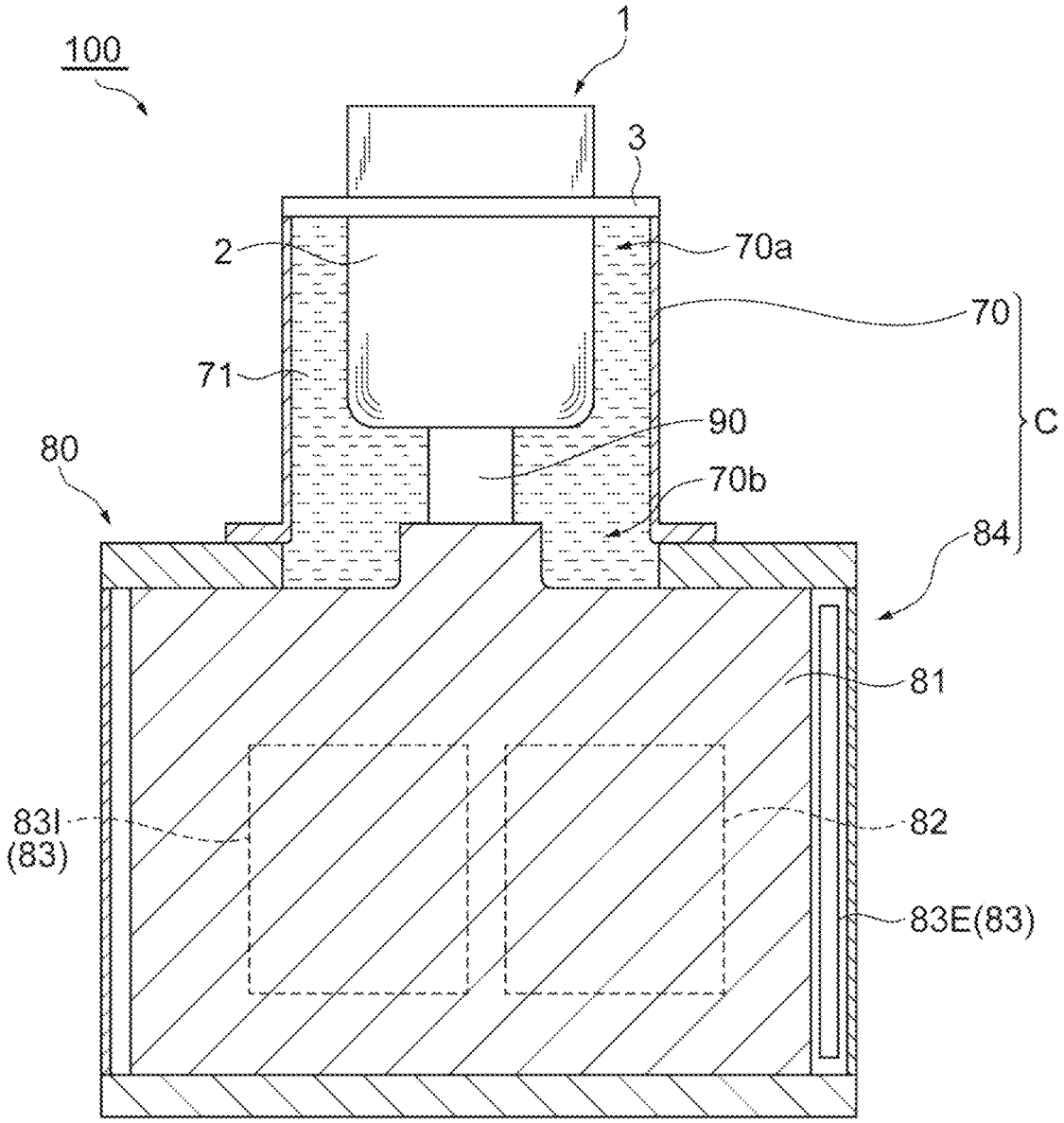
FIG. 1 is a longitudinal cross-sectional view showing an X-ray generation device according to an embodiment.

An embodiment according to an aspect of the present invention will now be described in detail with reference to the accompanying drawings. In each drawing, the same or corresponding elements are denoted by the same reference numerals, and redundant description may be omitted.

Figure 2:
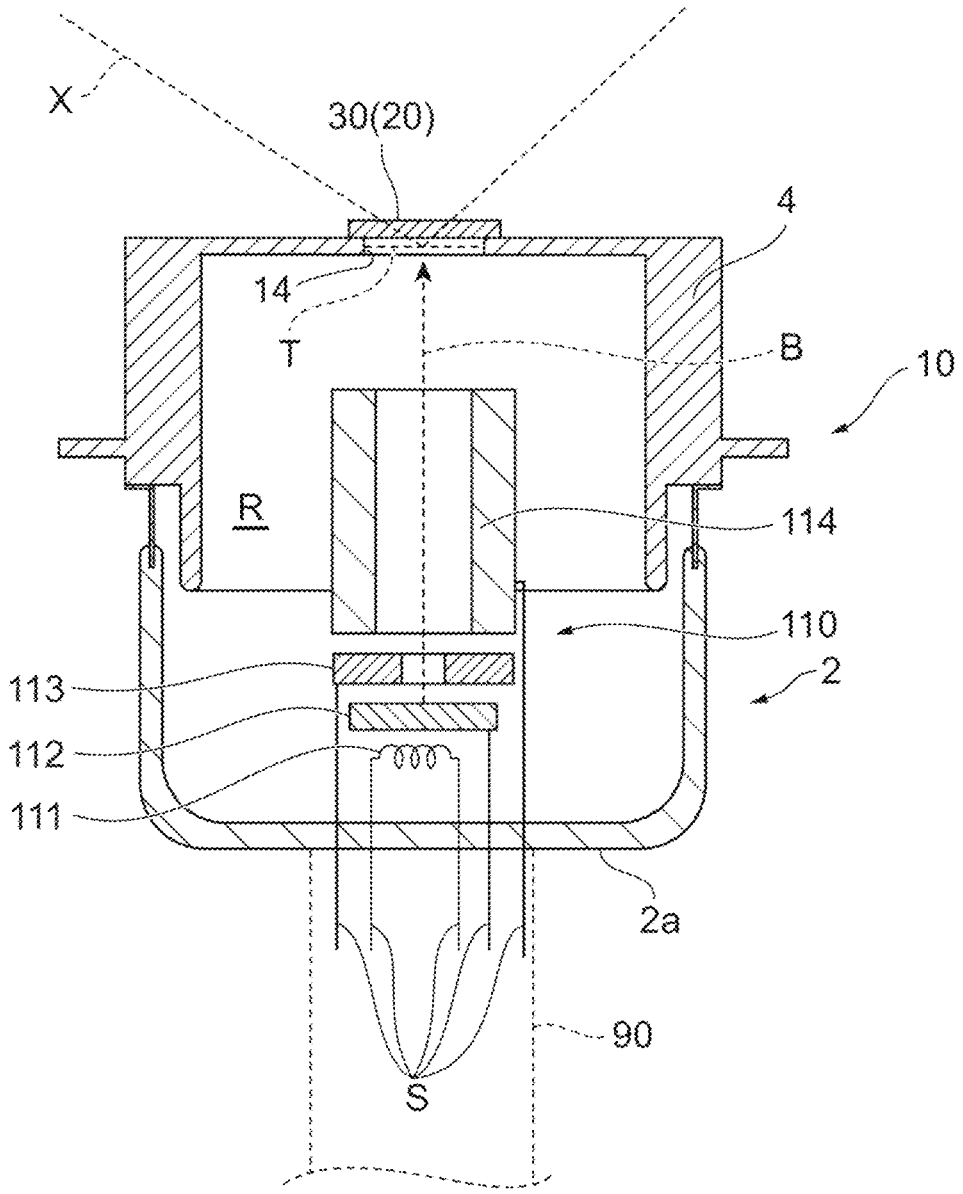
FIG. 2 is a longitudinal cross-sectional view showing an X-ray tube according to an embodiment.

FIG. 1 is a longitudinal cross-sectional view showing an X-ray generation device according to the embodiment. FIG. 2 is a longitudinal cross-sectional view showing an X-ray tube according to the embodiment. As shown in FIGS. 1 and 2, an X-ray generation device 100 is, for example, a microfocus X-ray source used for X-ray nondestructive inspection for observing an internal structure of a test object. The X-ray generation device 100 is provided with an X-ray tube 1, a housing C, and a power supply portion 80.

The X-ray tube 1 is a transmissive X-ray tube which emits an X-ray X from an X-ray emission window 30. The X-ray X is generated by an electron beam B from an electron gun 110 having entered a target T, and the target T transmits the X-ray X. The X-ray tube 1 is a vacuum sealed X-ray tube which is provided with a vacuum housing 10 including a vacuum internal space R and which does not require component replacement.

The vacuum housing 10 has a substantially cylindrical outline. The vacuum housing 10 has a head unit 4 made of a metallic material (for example, stainless steel) and an insulating valve 2 made of an insulating material (for example, glass). The X-ray emission window 30 is fixed to the head unit 4. The electron gun 110 is fixed to the insulating valve 2. The insulating valve 2 has a cylindrical outline extending along the axis of the X-ray tube 1 and has a bottom 2*a* at an end opposite to the X-ray emission window 30. A stem pin S for power feeding or the like penetrates the bottom 2*a* and is held by the bottom 2*a*. The stem pin S holds the electron gun 110 at a predetermined position in the internal space R.

The electron gun 110 includes a heater 111, a cathode 112 (electron-emitting unit), a first grid electrode 113 (electron quantity controlling electrode), and a second grid electrode 114. The heater 111 includes a filament that generates heat when energized. The cathode 112 functions as an electron-emitting source when heated by the heater 111. The first grid electrode 113 controls a quantity of electrons emitted from the cathode 112. The second grid electrode 114 having a cylindrical shape focuses electrons that have passed through the first grid electrode 113 toward the target T. The second grid electrode 114 doubles as an extraction electrode that forms an electric field for extracting electrons included in the electron beam B. The first grid electrode 113 is disposed between the cathode 112 and the second grid electrode 114. The X-ray tube 1 is fixed to one end of a cylindrical member 70 described below. Note that an exhaust pipe (not shown) is attached to the X-ray tube 1, and the inside of the X-ray tube 1 is evacuated through this exhaust pipe so as to be vacuum-sealed.

The housing C of the X-ray generation device 100 includes the cylindrical member 70 and a power supply portion case 84 that houses an insulating block 81 which is to be described as a part of the power supply portion 80. The cylindrical member 70 is made of metal. The cylindrical member 70 has a cylindrical shape having openings at both ends. The insulating valve 2 of the X-ray tube 1 is inserted into an opening 70*a* at one end of the cylindrical member 70. Accordingly, the cylindrical member 70 houses at least a part of the X-ray tube 1.

An attachment flange 3 of the X-ray tube 1 is brought into contact with one end surface of the cylindrical member 70 and is fixed thereto with a screw or the like. Accordingly, the X-ray tube 1 is fixed to the opening 70*a* of the cylindrical member 70 and seals the opening 70*a*. An insulating oil 71 which is a liquid electrical insulating substance is sealed within the cylindrical member 70.

The power supply portion 80 has a function of supplying power to the X-ray tube 1. The power supply portion 80 includes the insulating block 81, a booster circuit (booster) 82, a control substrate (control unit) 83, and the power supply portion case 84. The insulating block 81 is made of a molded solid insulating material such as an epoxy resin which is an insulating resin. The booster circuit 82 is molded inside the insulating block 81. The control substrate 83 performs control to generate the X-ray X. The power supply portion case 84 having a rectangular box shape houses the insulating block 81, the booster circuit 82, and the control substrate 83. The booster circuit 82 generates a high voltage V. The insulating block 81 seals the booster circuit 82 with an insulating material (epoxy resin). The insulating block 81 is not limited to one that includes a single insulating material and may include a plurality of insulating materials (insulating resins) combined according to the desired insulating characteristics or elastic characteristics. Alternatively, the insulating block 81 may be one that is constituted by a plurality of molded bodies.

The control substrate 83 performs the control to generate the X-ray X. For example, the control substrate 83 controls voltages or currents supplied to the X-ray tube 1 or controls driving of the booster circuit 82 so as to control operations of the X-ray generation device 100. The control substrate 83 includes an internal substrate 83I molded inside the insulating block 81 and an external substrate 83E disposed outside the insulating block 81. The other end of the cylindrical member 70 (the opposite side of one end close to the X-ray tube 1) is fixed to the power supply portion 80. Accordingly, an opening 70*b* at the other end of the cylindrical member 70 is sealed, and the insulating oil 71 is airtightly sealed within the cylindrical member 70.

A high-voltage power supply unit 90 is disposed on the insulating block 81. The high-voltage power supply unit 90 includes a cylindrical socket that is electrically connected to the booster circuit 82 and the control substrate 83. The power supply portion 80 is electrically connected to the X-ray tube 1 through the high-voltage power supply unit 90. More specifically, one end of the high-voltage power supply unit 90 close to the X-ray tube 1 is electrically connected to the stem pin S projecting from the bottom 2*a* of the insulating valve 2 in the X-ray tube 1. In addition, the other end of the high-voltage power supply unit 90 close to the power supply portion 80 is fixed to the insulating block 81 while electrically connected to the booster circuit 82 and the control substrate 83.

In this embodiment, the target T (anode) has a ground potential, and a negative high voltage (for example, from −10 kV to −500 kV) is supplied from the power supply portion 80 to the X-ray tube 1 (electron gun 110) via the high-voltage power supply unit 90.

The X-ray tube 1 includes the vacuum housing 10 and a target unit 20. In this embodiment, the side from which the X-ray tube 1 emits the X-ray X is simply referred to as "X-ray emission side" or "upper side". The X-ray emission side of the vacuum housing 10 is provided with the head unit 4 functioning as a wall portion that defines the internal space R. The head unit 4 is made of a metallic material (for example, stainless steel), and potentially corresponds to an anode of the X-ray tube 1. The head unit 4 has openings at both ends and has a substantially cylindrical shape coaxial with an axis of emission direction of the X-ray X. In an opening at the other end close to the electron gun 110, the head unit 4 communicates with the insulating valve 2 coaxial with the axis of emission direction (see FIG. 2).

The target unit 20 is fixed to the head unit 4. The target unit 20 includes the X-ray emission window 30 and the target T. The X-ray emission window 30 is provided so as to seal an opening 14 of the vacuum housing 10 (head unit 4). The target T is provided on a side surface of the internal space R of the X-ray emission window 30. The target T generates the X-ray X by receiving the electron beam B. An example of the target T is made of tungsten. The X-ray emission window 30 has a disk shape. The X-ray emission window 30 is made of a material having high X-ray transmissivity such as beryllium and diamond.

Figure 3:
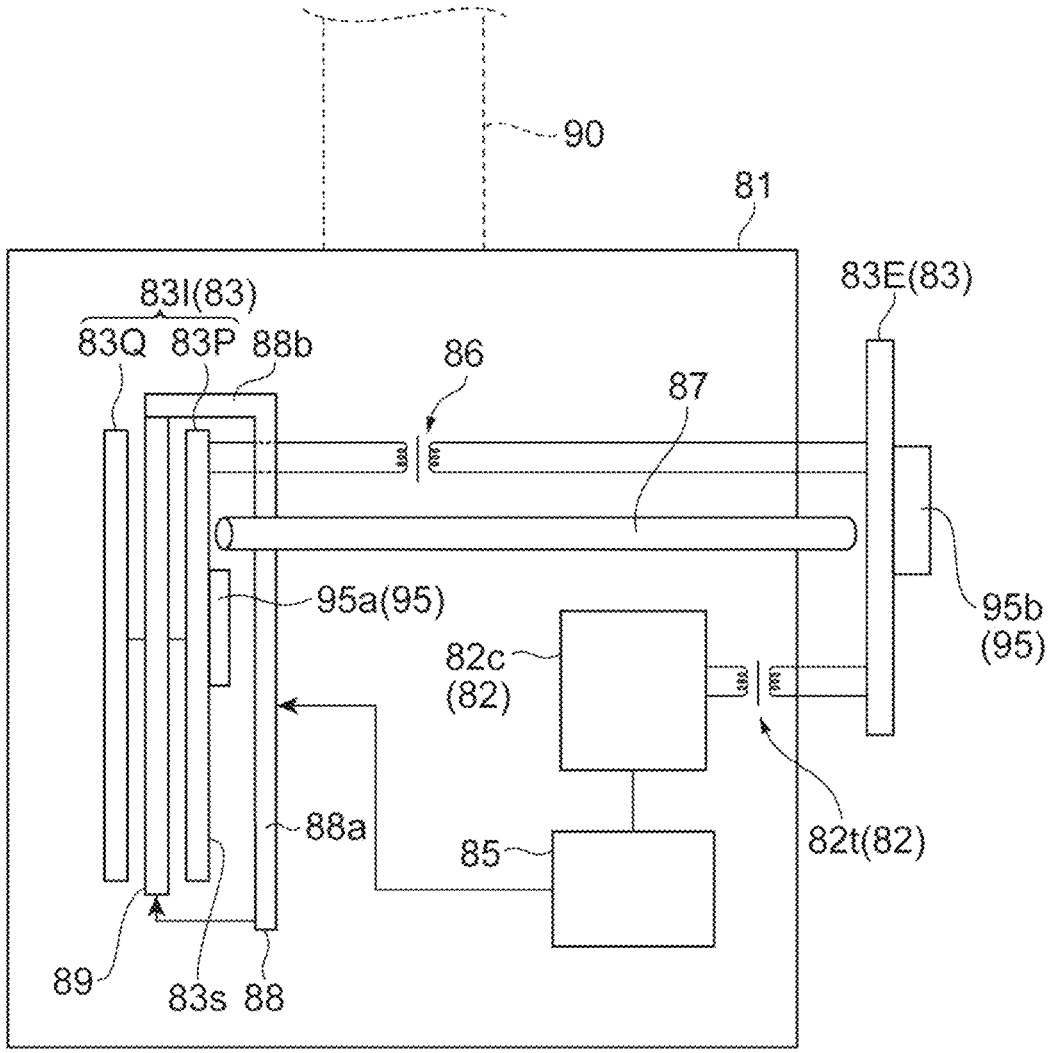
FIG. 3 is a view showing a power supply portion shown in FIG. 1.
Figure 4:
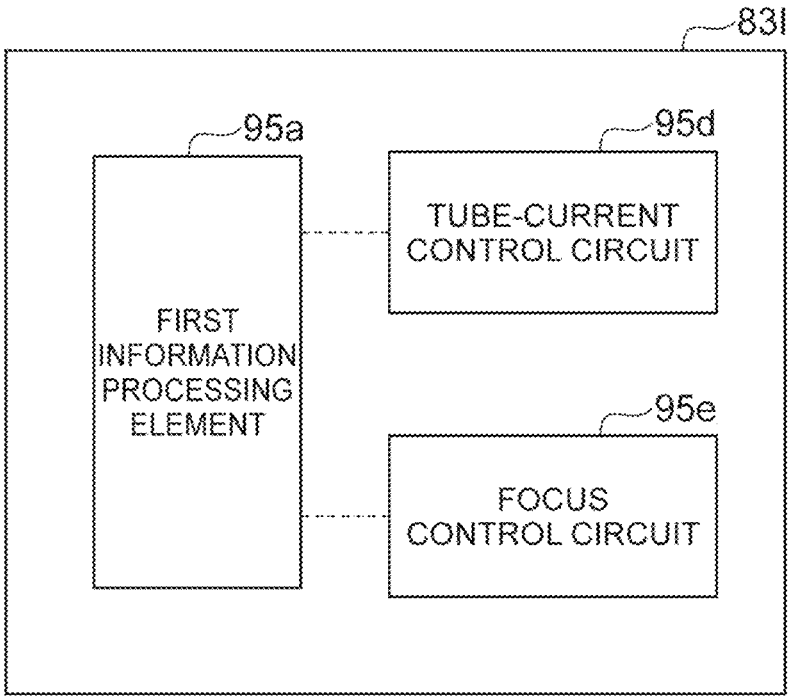
FIG. 4 is a functional block diagram of an internal substrate shown in FIG. 3.

Next, the power supply portion 80 will be specifically described with further reference to FIGS. 3 and 4. FIG. 3 is a diagram showing the power supply portion of FIG. 1. FIG. 4 is a functional block diagram of the internal substrate of FIG. 3. The power supply portion 80 includes the booster circuit 82. The booster circuit 82 includes a transformer 82*t* and a high-voltage generation circuit 82*c*. The high-voltage generation circuit 82*c* includes, for example, a multistage Cockcroft-Walton circuit. The booster circuit 82 boosts an input voltage Vo supplied via the external substrate 83E from an external power supply (not shown) connected to the X-ray generation device 100 so as to generate the high voltage V. The input voltage Vo has an absolute value of 100 V or less and is, for example, about −20 V in this embodiment.

As the control substrate 83 that performs the control to generate the X-ray X, the power supply portion 80 includes the internal substrate 83I molded inside the insulating block 81 and the external substrate 83E disposed outside the insulating block 81. The internal substrate 83I includes a first internal substrate 83P and a second internal substrate 83Q arranged substantially parallel to each other. The first internal substrate 83P and the second internal substrate 83Q are disposed on both sides of a substrate base 89 which is made of a conductive material. The first internal substrate 83P and the second internal substrate 83Q are fixed together to the substrate base 89 and are electrically connected to each other through the substrate base 89. Herein, the first internal substrate 83P is disposed closer to the center of the insulating block 81 than the second internal substrate 83Q. Furthermore, the external substrate 83E is disposed outside the insulating block 81 and inside a space between the insulating block 81 and the power supply portion case 84.

The control substrate 83 includes a control unit 95 that performs the control to generate the X-ray X. The control unit 95 includes at least a first information processing element 95*a* and a second information processing element 95*b* different from the first information processing element 95*a*. The first information processing element 95*a* and the second information processing element 95*b* are not a single electron device, such as a transistor and a resistor, which performs part of processing when forming a circuit. The first information processing element 95*a* and the second information processing element 95*b* are an integrated circuit element which includes a substrate on which various kinds of electron devices are mounted to make it into a circuit and which enables a series of information processing, that is, processing of a signal based on external input information, conversion of the signal into a signal indicating desired information, and output of the same. Specifically, examples of the first information processing element 95*a* and the second information processing element 95*b* include microcomputers and programmable logic devices (PLD) provided with a central processing unit (CPU) and a memory. The first information processing element 95*a* and the second information processing element 95*b* transmit and receive a digital signal and perform at least part of the control to generate the X-ray X using the digital signal. In addition, the control substrate 83 is provided with a control circuit that is driven based on the control by the first information processing element 95*a* and the second information processing element 95*b*. The control circuit outputs desired voltages or currents to, for example, the X-ray tube 1.

The first information processing element 95*a* is mounted on a main surface 83*s* of the first internal substrate 83P that is on the opposite side of the substrate base 89. Accordingly, the first information processing element 95*a* is sealed with the insulating material (insulating resin) together with the booster circuit 82. On the other hand, the second information processing element 95*b* is mounted on the external substrate 83E. Accordingly the second information processing element 95*b* is disposed outside the insulating block 81 (exposed from the insulating material (insulating resin)).

The external substrate 83E is a low-voltage operation substrate that operates at a low reference potential vp where a low potential based on a low voltage v lower than the high voltage V is regarded as a reference potential. In other words, since the external substrate 83E operates under an environment that is potentially extremely stable, the external substrate 83E is used for comprehensive control of the entire X-ray generation device 100. The low voltage v may have an absolute value of 10 kV or less. More specifically, the absolute value is 1 kV or less. In this embodiment, the low voltage v is 0 V (ground potential). The external substrate 83E supplies the input voltage Vo from the outside to the high-voltage generation circuit 82*c* via the transformer 82*t*.

More specifically, the external substrate 83E is connected to the external power supply (not shown), and the input voltage Vo supplied from the external power supply to the external substrate 83E is primarily boosted to about several kV by the transformer 82*t* that electrically connects the external substrate 83E and the high-voltage generation circuit 82*c*, and then, the input voltage Vo is supplied to the high-voltage generation circuit 82*c*. Then, the high-voltage generation circuit 82*c* secondarily boosts the input voltage Vo and generates the high voltage V. The second information processing element 95*b* controls the external substrate 83E and the booster circuit 82. In other words, at the low reference potential vp, or at the low potential based on the low voltage v, the second information processing element 95*b* controls the external substrate 83E, controls the supply of the input voltage Vo to the booster circuit 82, and controls the booster circuit 82, as the control to generate the X-ray X.

In short, the second information processing element 95*b* controls a high reference potential Vp where a high potential based on the high voltage V generated by the booster circuit 82 (high-voltage generation circuit 82*c*) is regarded as a reference potential. More specifically, the second information processing element 95*b* receives information associated with the actual value of the generated high voltage V from the booster circuit 82 or the like, and then, feedbacks the high voltage V (high reference potential Vp) based on the information. Note that a current is also supplied from the external power supply, and the current is controlled by the second information processing element 95*b* in a similar manner to the voltage. In other words, the second information processing element 95*b* controls the power supplied from the external power supply to the booster circuit 82.

The internal substrate 83I is electrically connected to the booster circuit 82 (high-voltage generation circuit 82*c*) via a current-limiting resistor 85. More specifically, the internal substrate 83I is electrically connected to the booster circuit 82 (high-voltage generation circuit 82*c*) through the current-limiting resistor 85, a cover electrode 88 to be described, and the substrate base 89. Accordingly, the high voltage V from the booster circuit 82 (high-voltage generation circuit 82*c*) is applied to the internal substrate 83I (the first internal substrate 83P and the second internal substrate 83Q). In other words, the internal substrate 83I (the first internal substrate 83P and the second internal substrate 83Q) is a high-voltage operation substrate that operates at the high reference potential Vp where the high potential based on the high voltage V is regarded as a reference potential.

Accordingly, the first information processing element 95*a* also operates at the high reference potential Vp where the high potential based on the high voltage V is regarded as a reference potential. The high voltage V (high reference potential Vp) is, for example, −100 kV. While the high voltage V is insulated, a drive power E for driving the first internal substrate 83P, the second internal substrate 83Q, and the first information processing element 95*a* included in the internal substrate 83I is supplied from the external substrate 83E to the internal substrate 83I through the transformer 86 molded inside the insulating block 81. In other words, the first internal substrate 83P, the second internal substrate 83Q, and the first information processing element 95*a* included in the internal substrate 83I are driven by the drive power E while the high reference potential Vp is regarded as an imaginary ground potential.

In addition, the first information processing element 95*a* electrically connects the heater 111, the cathode 112, the first grid electrode 113, and the second grid electrode 114 which are included in the electron gun 110 via the high-voltage power supply unit 90 and the stem pin S. Accordingly, the first information processing element 95*a* at least partially controls driving of components such as the heater 111, the cathode 112, the first grid electrode 113, and the second grid electrode 114 (the electron gun 110) which are relevant to the generation of the X-ray X in the X-ray tube 1.

Specifically, the first information processing element 95*a* controls the power supplied to each of those components. Herein, an example of the control of an applied voltage to each component will be described. At the high reference potential Vp based on the high voltage V of −100 kV, the first information processing element 95*a* controls the first grid electrode 113 to have a voltage about −1500 V, the cathode 112 to have a voltage about −1000 V, the heater 111 to have a voltage about −5 V from the potential of the cathode 112, and the second grid electrode 114 to have a voltage of 0 V (that is, an imaginary ground potential). In other words, the first information processing element 95*a* controls an actual applied voltage with respect to the first grid electrode 113, the cathode 112, the heater 111, and the second grid electrode 114 to be, for example, −100 kV+(−1500 V), −100 kV+(−1000 V), −100 kV+(−1000 V)+(−5 V), and −100 kV, respectively.

As in the above example, when a voltage equal to the high voltage V which is at the high reference potential Vp is supplied to the second grid electrode 114, the second grid electrode 114 may be electrically connected to the booster circuit 82 (high-voltage generation circuit 82*c*) in a direct manner without the internal substrate 83I (first information processing element 95*a*) involved. In this case, the second grid electrode 114 is controlled by the second information processing element 95*b* of the external substrate 83E in a similar manner to the booster circuit 82. Furthermore, the first information processing element 95*a* performs feedback control on a tube current by controlling the heater 111, the cathode 112, and the first grid electrode 113 and performs feedback control on focus (focus of the electron beam B) by controlling the cathode 112 and the second grid electrode 114.

In the above example, a voltage Vr in a predetermined range from −1500 V to 0 V is added to the high voltage V (−100 kV) which is at the high reference potential Vp, and the voltage Vr is appropriately applied to each of the heater 111, the cathode 112, the first grid electrode 113, and the second grid electrode 114. However, note that the high voltage V is attributed to a voltage supplied from the booster circuit 82, while the voltage Vr in the predetermined range is attributed to a driving power supply (not shown) provided in the internal substrate 83I and driven by the drive power W. When the voltage Vr in the predetermined range is 0 V (that is, when the voltage Vr is equal to the high voltage V), the voltage Vr may be supplied from the booster circuit 82 without using the driving power supply. In other words, the first information processing element 95*a* controls the electron gun 110 at the voltage Vr in the predetermined range while the high reference potential Vp is regarded as an imaginary ground potential.

However, the above voltages are an example, and the voltages applied to the components of the electron gun 110 (the heater 111, the cathode 112, the first grid electrode 113, and the second grid electrode 114) may be changed appropriately. Furthermore, the high voltage V and the voltage Vr in the predetermined range may be defined in the following manner. That is, the absolute value of the high voltage V (high reference potential Vp) controlled by the first information processing element 95*a* may be 10 kV or more and 500 kV or less. In this case, in the voltages applied to the components of the electron gun 110 in the X-ray tube 1 (the heater 111, the cathode 112, the first grid electrode 113, and the second grid electrode 114) controlled by the first information processing element 95*a*, the voltage Vr in the predetermined range excluding a voltage corresponding to the high voltage V (that is, a voltage corresponding to a potential difference with respect to the high reference potential Vp) may be 4% or less of the high voltage V, and the maximum of the absolute value of the voltage Vr in the predetermined range may be 25 V or more and 20 kV or less. More specifically, the absolute value of the high voltage V (high reference potential Vp) is 10 kV or more and 300 kV or less, the voltage Vr in the predetermined range is 2% or less of the high voltage V, and the maximum of the absolute value of the voltage Vr in the predetermined range is 50 V or more and 6 kV or less. Since the voltage Vr in the predetermined range includes a voltage at 0% of the high voltage V, the voltage Vr also includes a case where a voltage applied to each component of the electron gun 110 in the X-ray tube 1 (that is, the heater 111, the cathode 112, the first grid electrode 113, and the second grid electrode 114) controlled by the first information processing element 95*a* is equal to the high voltage V generated by the booster circuit 82 (high-voltage generation circuit 82*c*).

As described above, in the X-ray generation device 100, the electron gun 110 includes the heater 111 including a filament that generates heat when energized; the cathode 112 that functions as an electron-emitting source when heated by the heater 111; the second grid electrode 114 as an extraction electrode that forms an electric field for extracting electrons included in the electron beam B from the cathode 112; and the first grid electrode 113 which is disposed between the cathode 112 and the second grid electrode 114 and which controls a quantity of electrons emitted from the cathode 112. At the voltage Vr in the predetermined range at the high reference potential Vp, the first information processing element 95*a* controls applied voltages to drive at least a part of components (the electron gun 110), for example, the heater 111, the cathode 112, the first grid electrode 113, and the second grid electrode 114 which are relevant to the generation of the X-ray X in the X-ray tube 1.

A concrete example of the control will now be described. As described above, the first information processing element 95*a* controls the tube current in the X-ray tube 1 and controls the focus. Accordingly, as shown in FIG. 4, the internal substrate 83I includes the first information processing element 95*a* (for example, a microcomputer or PLD), a tube-current control circuit 95*d* driven by the control of the first information processing element 95*a*, and a focus control circuit 95*e*. At least a part of the driving power supply that supplies the voltage Vr in the predetermined range is included in the tube-current control circuit 95*d* and the focus control circuit 95*e*. Through a communication unit such as an optical fiber 87, the first information processing element 95*a* transmits and receives a digital signal that indicate control information between the second information processing element 95*b* (for example, a microcomputer or PLD) that stores data of various kinds of supply electrodes based on predetermined drive conditions in the X-ray tube 1.

Note that the communication unit used to transmit and receive a digital signal may be wireless or the like. Digital signals are excellent in processing ability and noise resistance with respect to minute signals, which enables transmission and reception of high-accuracy signals. Accordingly, it is possible to control outputs to the tube-current control circuit 95*d* and the focus control circuit 95*e* with high accuracy, that is, within the error range of 0.1% or less, even between the internal substrate 83I and the external substrate 83E, or between the high reference potential Vp and the low reference potential vp, which greatly differ to each other in potential. The transmission and reception of signals between the first information processing element 95*a* and the second information processing element 95*b* are not limited to digital signals, and FM communication or the like may be employed.

For example, when a signal indicating control information is input to the second information processing element 95*b* from an external input unit (not shown) such as a personal computer connected to the X-ray generation device 100, based on the signal, the second information processing element 95*b* outputs a digital signal indicating the control information to the first information processing element 95*a*, and the first information processing element 95*a* performs information processing using the digital signal. When the tube current is to be controlled, the first information processing element 95*a* outputs a signal to the tube-current control circuit 95*d*. The tube-current control circuit 95*d* supplies a drive voltage to the heater 111, the cathode 112, and the first grid electrode 113 using the high voltage V and the voltage Vr in the predetermined range according to the input signal. Accordingly, the first information processing element 95*a* controls the tube current in the X-ray tube 1. Furthermore, when tube current information is input from a tube current acquisition unit (not shown) to the first information processing element 95*a*, the first information processing element 95*a* performs feedback control of the tube current.

When the focus is to be controlled, the first information processing element 95*a* outputs a signal to the focus control circuit 95*e*. The focus control circuit 95*e* supplies a drive voltage to the cathode 112 and the second grid electrode 114 using the high voltage V and the voltage Vr in the predetermined range according to the input signal. Accordingly, the first information processing element 95*a* controls the focus in the X-ray tube 1. Furthermore, when focus information is input from a focus information acquisition unit (not shown) to the first information processing element 95*a*, the first information processing element 95*a* performs feedback control of the focus.

Herein, the power supply portion 80 further includes the cover electrode (conductive member) 88. The cover electrode 88 is made of, for example, a metallic material such as stainless steel or aluminum. The cover electrode 88 is sealed with the insulating material (insulating resin) in the insulating block 81. The cover electrode 88 is formed into an L-shape by a first portion 88*a* and a second portion 88*b* both having a flat-plate shape. The first portion 88*a* extends along the central axis of the X-ray generation device 100. The second portion 88*b* is erected in a direction intersecting with an extension direction of the first portion 88*a* at an upper end of the first portion 88*a* (an end close to the X-ray tube 1) in a direction along the central axis of the X-ray generation device 100. The cover electrode 88 is disposed such that the first portion 88*a* faces the main surface 83*s* of the first internal substrate 83P. Accordingly, when viewed in a direction intersecting the main surface 83*s*, most of the main surface 83*s* and the entire first information processing element 95*a* on the main surface 83*s* are covered with the cover electrode 88 (first portion 88*a*). In other words, the cover electrode 88 (first portion 88*a*) blocks the booster circuit 82 (high-voltage generation circuit 82*c*) from the first information processing element 95*a* (main surface 83*s* of the first internal substrate 83P).

Furthermore, herein, at least the upper end of the first information processing element 95*a* (close to the X-ray tube 1) is covered with the cover electrode 88 (second portion 88*b*) when viewed from a direction along the main surface 83*s*. In other words, the power supply portion 80 includes the cover electrode 88 which covers at least a part of the first information processing element 95*a* and which is sealed with the insulating material (insulating resin) in the insulating block 81.

To the cover electrode 88, a voltage Vc based on the high voltage V is applied. The voltage Vc is, for example, obtained by adding the voltage Vr in the predetermined range to the high voltage V. In this embodiment, the voltage Vc is equal to the high voltage V since the voltage Ve is supplied from the booster circuit 82 (high-voltage generation circuit 82*c*) via the current-limiting resistor 85.

As described above, similarly, the high voltage V is applied to the substrate base 89, the first internal substrate 83P, and the second internal substrate 83Q. In short, herein, the first internal substrate 83P and the second internal substrate 83Q are fixed, and the substrate base 89 electrically connected to those internal substrates is electrically connected to the cover electrode 88. In other words, since the first information processing element 95*a* that operates at the high reference potential Vp is surrounded by the cover electrode 88 and the substrate base 89 which also operate at the high reference potential Vp (high voltage V), an electric field around the first information processing element 95*a* is stabilized, which enables stable operation of the first information processing element 95*a*.

As described above, the X-ray generation device 100 includes the X-ray tube 1 and the power supply portion 80. The power supply portion 80 supplies the high voltage V to the X-ray tube 1. For that reason, the power supply portion 80 includes the booster circuit 82 that boosts the input voltage Vo from the outside to generate the high voltage V. Since the booster circuit 82 is a high-voltage section, the insulating block 81 is sealed with the insulating material (insulating resin).

On the other hand, the power supply portion 80 includes the control unit 95 that performs the control to generate the X-ray X. The control unit 95 includes the first information processing element 95*a* that performs at least part of the control to generate the X-ray X using a digital signal. The first information processing element 95*a* is sealed with the insulating material (insulating resin) in the insulating block 81 together with the booster circuit 82. Accordingly, even at the high reference potential Vp based on the high voltage V, the first information processing element 95*a* enables stable control.

In the X-ray generation device 100, the power supply portion 80 further includes the cover electrode 88 which covers at least a part of the first information processing element 95*a* and which is sealed with the insulating material (insulating resin) in the insulating block 81. The voltage Vc based on the high voltage V is applied to the cover electrode 88. Therefore, an electric field around the first information processing element 95*a* is stabilized, which enables stable operation of the first information processing element 95*a*.

For example, when a discharge occurs in the X-ray tube 1, the potentials of the X-ray tube 1 and the internal substrate 83I (the first internal substrate 83P, the second internal substrate 83Q, and the first information processing element 95*a*) quickly drop to the ground potential through a discharging path generated in the X-ray tube 1. On the other hand, the potential of the booster circuit 82 (high-voltage generation circuit 82*c*) drops to the ground potential in the discharging path after passing through the current-limiting resistor 85 or drops to the ground potential through the multistage Cockcroft-Walton circuit. Accordingly, the internal substrate 83I (the first internal substrate 83P, the second internal substrate 83Q, and the first information processing element 95*a*) reaches the ground potential first, and then, the booster circuit 82 (high-voltage generation circuit 82*c*) reaches the ground potential with a slight difference in time. Therefore, in a short time, a potential difference corresponding to the high voltage V (high reference potential Vp) at a maximum is generated between the first information processing element 95*a* and the booster circuit 82 (high-voltage generation circuit 82*c*), which may cause a very strong electric field. Therefore, if the electric field reaches the first information processing element 95*a*, the first information processing element 95*a* may be broken.

On the other hand, herein, the cover electrode 88 (first portion 88*a*) blocks the booster circuit 82 (high-voltage generation circuit 82*c*) from the first information processing element 95*a*. Accordingly, for example, even when a discharge occurs in the X-ray tube 1 as described above, the cover electrode 88 prevents influences of an electric field generated by the discharge, which prevents failure of the first information processing element 95*a*. Furthermore, the first information processing element 95*a* includes the second portion 88*b* that blocks the first information processing element 95*a* from the X-ray tube 1, and the second portion 88*b* prevents the first information processing element 95*a* from being directly affected by the discharge in the X-ray tube 1.

In the X-ray generation device 100, the first information processing element 95*a* controls the electron gun 110 at the high reference potential Vp. As described above, herein, the first information processing element 95*a* is sealed with the insulating material (insulating resin) in the insulating block 81. Accordingly, it is possible to stably control the generation and emission of the electron beam from the electron gun 110.

Furthermore, in the X-ray generation device 100, the control unit 95 further includes the second (another) information processing element 95*b* that performs the control to generate the X-ray X at the low reference potential vp based on the low voltage v lower than the high voltage V. The second information processing element 95*b* is disposed outside the insulating block 81. Accordingly, the second information processing element 95*b* disposed outside the insulating block 81 makes it possible to stably control generation of the X-ray X.

The aforementioned embodiment illustrates an embodiment of the X-ray generation device according to an aspect of the present invention. Therefore, the X-ray generation device according to an aspect of the present invention is not limited to the X-ray generation device 100. The X-ray generation device according to an aspect of the present invention may be one obtained by optionally modifying the X-ray generation device 100 within the scope of the claims. For example, the insulating material forming the insulating block 81 is not limited to an insulating resin and may be an insulating material other than the resin, for example, ceramic. In addition, the high voltage V may be supplied not to the electron gun 110 but to the target T. Further more, the X-ray tube may not necessarily be of the transmissive type but may be of a reflective type in which a reflective target is used. Still further, the electron gun 110 may include another grid electrode or may use a cold cathode.

INDUSTRIAL APPLICABILITY

Provided is an X-ray generation device that enables stable control at a high potential.

REFERENCE SIGNS LIST

1 X-ray tube
80 Power supply portion
81 Insulating block
82 Booster circuit (booster)
88 Cover electrode (conductive member)
95 Control unit
95*a* First information processing element
95*b* Second information processing element
110 Electron gun
112 Cathode
113 First grid electrode
114 Second grid electrode
b Electron beam
t Target
x X-ray

The invention claimed is:

1. An X-ray generation device comprising:

an X-ray tube including an electron gun configured to generate an electron beam and a target configured to generate an X-ray by incidence of the electron beam;

a power supply portion including a booster configured to boost an input voltage from outside to generate a high voltage and an insulating block configured to seal the booster with an insulating material; and a control unit configured to perform control to generate the X-ray, wherein the control unit includes a first information processing element configured to perform at least part of the control using a digital signal at a high potential based on the high voltage, wherein the first information processing element is sealed with the insulating material in the insulating block, wherein the power supply portion further includes a conductive member covering at least a part of the first information processing element and sealed with the insulating material in the insulating block, wherein a voltage based on the high voltage is applied to the conductive member, wherein the first information processing element is mounted on a substrate which is disposed outside the X-ray tube, and wherein the conductive member blocks the booster from the first information processing element.

2. The X-ray generation device according to claim 1, wherein the first information processing element controls the electron gun at the high potential.

3. The X-ray generation device according to claim 1, wherein the control unit further includes a second information processing element configured to perform the control at a low potential based on a low voltage lower than the high voltage, wherein the second information processing element is disposed outside the insulating block.

* * * * *